US006212808B1

(12) United States Patent
Rubel

(10) Patent No.: US 6,212,808 B1
(45) Date of Patent: Apr. 10, 2001

(54) SAFETY IDENTIFICATION ASSEMBLY AND METHOD

(76) Inventor: Horacio Franklin Rubel, Jerónimo Salguero 540, 9th Fl. Apt. "20", Buenos Aires (1177) (AR)

( * ) Notice: Subject to any disclaimer, the term of this patent is extended or adjusted under 35 U.S.C. 154(b) by 0 days.

(21) Appl. No.: 09/419,282

(22) Filed: Oct. 15, 1999

Related U.S. Application Data

(62) Division of application No. 08/839,078, filed on Apr. 23, 1997, now abandoned.

(30) Foreign Application Priority Data

Apr. 24, 1996 (AR) ..... 336263
Apr. 21, 1997 (AR) ..... P970101606

(51) Int. Cl.[7] ..... A44C 5/00
(52) U.S. Cl. ..... 40/633; 40/666; 606/120; 283/75
(58) Field of Search ..... 40/304, 633, 665, 40/666, 668; 292/307 R, 308, 314, 325, 307 A; 283/75, 81; 606/120

(56) References Cited

U.S. PATENT DOCUMENTS 2,954,620 * 10/1960 Schneider ..... 40/633
3,027,665 * 4/1962 St. John ..... 40/633
3,656,247 * 4/1972 Bushnell et al. ..... 40/633
4,318,234 * 3/1982 Charles et al. ..... 40/633 X
5,006,830 * 4/1991 Meritt ..... 40/633 X
5,281,228 * 1/1994 Wolfson ..... 40/300 X
5,484,060 * 1/1996 Middle et al. ..... 40/324 X
5,581,924 * 12/1996 Peterson ..... 40/633
5,608,382 * 3/1997 Webb et al. ..... 340/573
5,615,504 * 4/1997 Peterson et al. ..... 40/633
5,938,666 * 8/1999 Reynolds et al. ..... 606/120

FOREIGN PATENT DOCUMENTS

001695 B1 1/2000 (AR) .

OTHER PUBLICATIONS

Abstract of JP11306240, published May 11, 1999, and attached Figures A and B.

* cited by examiner

*Primary Examiner*—Brian K. Green
(74) *Attorney, Agent, or Firm*—Evenson, McKeown, Edwards & Lenahan, P.L.L.C.

(57) ABSTRACT

A safety identification assembly for use in neonatology comprising identifying sub-assemblies detachably connected to each other and capable of being easily and manually detached in a delivery room immediately upon the baby delivery, wherein the sub-assemblies are used for identifying the mother and her baby or babies and for closing umbilical cord ends when the cord is out into two sections, one section of the cord remaining joined to the baby and the other section remaining joined to the placenta's mother. A method for identifying a baby and his/her mother in a delivery room is also provided.

1 Claim, 4 Drawing Sheets

SAFETY IDENTIFICATION ASSEMBLY AND METHOD

This application is a divisional of application Ser. No. 08/839,078, filed Apr. 23, 1997 now abandoned.

BACKGROUND OF THE INVENTION

1. Field of the Invention

The present invention relates to a safety identification assembly and an identification method and, more particularly refers to an identification system for identification of persons, such as two or more persons pertaining to a group and, even more particularly to be used in neonatology for identifying a newborn and his/her mother immediately after the mother is delivered of the baby, by practically simultaneously attaching the system to the newborn and the mother to identify them in an unalterable and in a violation-proof manner.

2. Description of the Prior Art

It is well known to provide several means to identify a newborn after his/her mother is delivered of. The obstetrician is at the delivery room in a maternity hospital the responsible person for all the facts carried out in the room and for the certification of the newborn identification. At the deliverance the newborn and the mother remain joined through the umbilical cord which is to be cut or divided into sections, one section remaining attached to the newborn and the other section remaining with the mother's placenta. A metal clamp is clamped at each end of the cord section so that the cord section where the clamp is placed becomes strangulated. With the umbilical cord end closed with such clamps, the baby is then taken to a child care room adjacent to the delivery room wherein the baby is subjected to the first cares, washed, identified by taking the plantar print, and the information is recorded for control purposes. A bracelet containing the baby's name and other data thereof is generally placed in a wrist of the newborn. The metal clamps closing the umbilical cord are then removed and replaced by plastic disposable clamps which may remain in the umbilical cord until the cord is naturally reduced, strangulated and cut.

Regarding the means for the identification of the baby, the bracelet is the only one identifying device attached to the baby, the bracelet containing the data corresponding to the records entered in the control forms of the maternity hospital. If the data entered into the forms is not the correct one or, if one baby is mistakenly assigned to a mother a situation may arise where two or more babies become interchanged. In this situation the bracelet is not a guarantee that the maternity personnel will become aware of the mistake and the error is to be corrected. Thus, there is not a way to reconcile the information contained in the baby's bracelet other than against the forms filled out after the deliverance. That is, there is not a link between the baby and his/her mother that could be checked or reconciled to confirm that the baby is the correct one or that an error has been committed.

As stated above, the obstetrician is the person who is responsible for most of the cares to the baby and the identification thereof, however, after the deliverance, once the umbilical cord has been cut and the baby taken out of the deliverance room the obstetrician remains in the room taking care of the mother and the baby is attended out of the obstetrician's sight. Even when any error could have been committed with the baby's identification the obstetrician is the responsible for certifying his identity which act may be also certified by the maternity hospital. Such error may be committed involuntarily due to the numerous childbirths occurring in a hospital, particularly in specialized maternity hospitals where so many deliveries are practically simultaneous and handling and control thereof may be an overburden to the nurses and medical personnel.

It would be therefore very convenient to count on a safety system for identifying the baby in a way that the baby and his/her mother are linked by an ID system under the obstetrician's sight, whereby the above mistakes and the disastrous consequences thereof are prevented from being committed either involuntarily or intentionally.

3. Summary of the Invention

It is therefore one object of the present invention to provide a safety identification assembly to be preferably used in neonatology for identifying one or more newborns and his/her mother in a way that an identification link is formed between the baby or babies and the mother, the assembly comprising as many identification sub-assemblies as persons are to be identified, that is the mother and her baby or babies, the sub-assemblies being firmly placed in the mother's body and the baby's body practically simultaneously and immediately after the delivery upon the obstetrician sight.

It is still another object of the present invention to provide a safety identification assembly for use in neonatology comprising identifying sub-assemblies detachably connected to each other and capable of being easily and manually detached in the deliverance room immediately upon the baby delivery, wherein the sub-assemblies are used for identifying the mother and her baby or babies and for closing the umbilical cord ends when the cord is cut, as usual, in two sections, one section of the cord remaining joined to the baby and the other section remaining joined to the placenta's mother.

It is even a further object of the present invention to provide a safety identification assembly of the type used for identifying individuals, particularly in neonatology to be applied to a newborn and his/her mother in a childbirth, wherein the identification assembly comprises at least two sub-assemblies connected to each other by at least one detachable connection, each sub-assembly comprising a closing clamp to be clamped at one side of a splitting section of a umbilical cord and a sealing device comprising a bracelet strap and violation-proof locking means for sealing the bracelet strap around the wrist of one of the newborn and his/her mother, each of the clamps and the sealing devices including an identification portion containing an identification code.

It is still a further object of the invention to provide a method for identifying a newborn and his/her mother in a delivery at a delivery room, with the above mentioned identification assembly, the method comprising the steps of:

- arranging the two sub-assemblies relative the umbilical cord so as to locate each clamp at both sides of the splitting section of the cord;
- closing each clamp so as to strangulate the umbilical cord at the both sides of the splitting section;
- cutting said splitting section of the cord while separating said sub-assemblies from each other, the clamps remaining clamped in respective divided lengths of the umbilical cord;
- separating said sealing devices from the clamps and putting the bracelet straps around the mother and baby's wrist respectively; and
- sealing the locking means to safely retain the bracelets in the mother and baby's wrists.

The above and other objects, features and advantages of this invention will be better understood when taken in connection with the accompanying drawings and description.

BRIEF DESCRIPTION OF THE DRAWINGS

The present invention is illustrated by way of example in the following drawings wherein.

DESCRIPTION OF THE PREFERRED EMBODIMENTS

Figure 1:
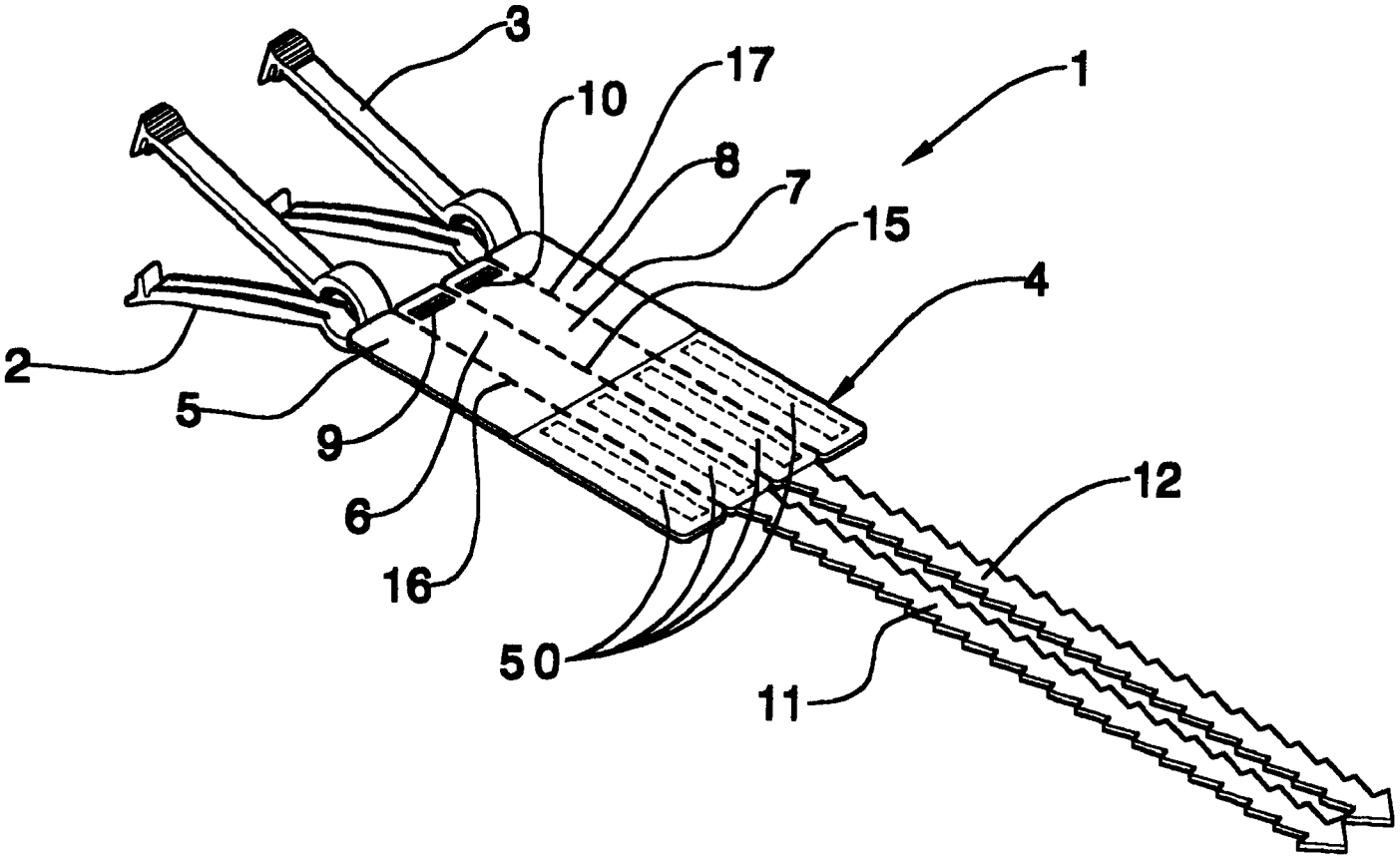
FIG. 1 shows a perspective view of a safety identification assembly comprising two identification sub-assemblies according to a first embodiment of the invention.
Figure 2:
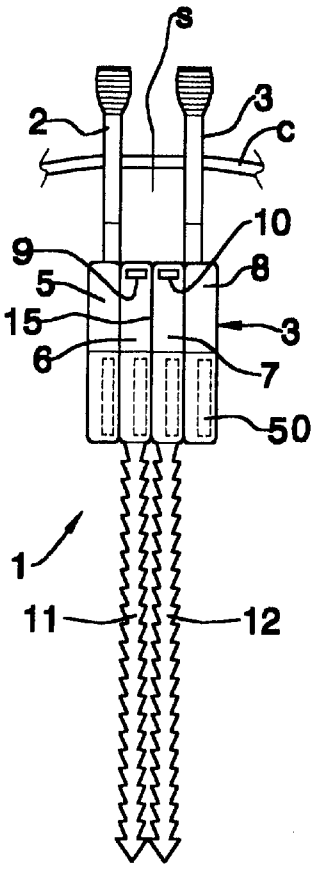
FIG. 2 shows a top plan view of the identification assembly of FIG. 1.

Now referring in detail to the drawings it may be seen from FIGS. 1, 2 that the safety identification assembly of the invention is generally indicated by reference number 1, including two clamps 2, 3 of the type used in neonatology to be applied to an umbilical cord C to strangulate the same at both sides of a splitting section S located between both clamps 2, 3 when the clamps are closed around cord C as it is shown in FIG. 2. As it is well known, the umbilical cord is divided at section S into two lengths or sections, each length remaining attached with the mother and the newborn, respectively. Clamps 2, 3 are joined to a plate 4 comprising four tags 5–8, i.e. two peripheral tags 5, 8 and two central tags 6, 7 each tag 5–8 including an identification portion 5, therefore four identification portions 5 being provided in the assembly. Identification portion 5 may contain any kind of data codes, numbers, letters or alphanumeric codes, engraved, or printed by any process in tags 5–8.

Each central tag 6, 7 has at one end thereof a locking notch 9, 10, respectively and, at the opposite end, a bracelet strap 11, 12, respectively. Straps 11, 12 defined respective saw-edged bracelet portions with the purposes of inserting respective ends 18, 19 through notches 9, 10 respectively. Once the straps have been inserted into notches 9, 10 the strap can only be moved in the insertion direction while any reverse moving is prevented by the saw profile of the straps the teethed edges of which are interlocked within the respective notch 9, 10. Thus, if the bracelet is intentionally removed from the wrist of one baby to be put in another baby enough evidence of this removal will call the maternity personnel attention.

Figure 3:
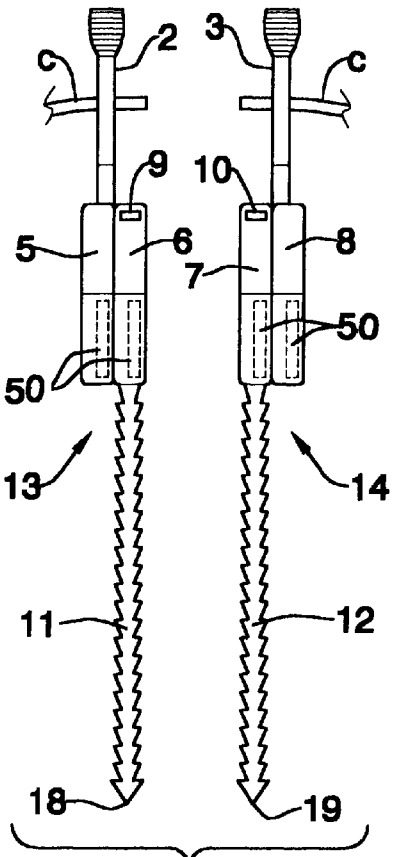
FIG. 3 shows a top plan view of the identification assembly similar to FIG. 2 but with the sub-assemblies detached and spaced apart from each other.

Two sub-assemblies 13, 14 are thus formed, sub-assembly 13 being comprised by clamp 2, tags 5, 6 and bracelet strap 11, and sub-assembly 14 comprising clamp 3, tags 7, 8 and bracelet strap 12. The sub-assemblies are connected to each other through a detachably connection indicated by line 15. Assembly 1 is preferably made from a plastic material and, more preferably from plastic by an injection process. Connection line 15 is preferably a weakened section wherein the thickness of the plastic along connection line 15 is thinner than the adjacent and associated tags 6, 7, and preferably severely thinner so as to provide a section capable of being manually and easily torn out to separate both sub-assemblies as it is shown in FIG. 3. A plurality of aligned cuts or perforations (not shown) can also be provided in line 15 by a stamping process, for example.

Figure 4:
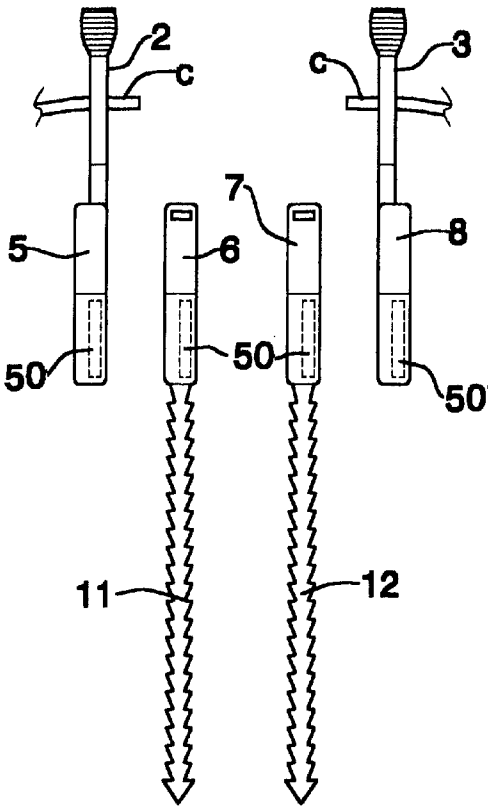
FIG. 4 shows a top plan view of the identification assembly similar to FIG. 3 with the closing clamp and the bracelet strap of each sub-assembly in turn detached from each other.

Within each sub-assembly 13, 14, tags 5, 6 and 7, 8 are also detachably connected to each other through detachably connecting lines 16, 17, respectively. The same features above disclosed in relation to connecting line 15 are applied to lines 16, 17 except that line 15 may be thinner than lines 16, 17 as far as line 15 is to be torn out first while lines 16, 17 should keep tags 5, 6 and tags 7, 8 joined together when line 15 is being manually broken. FIG. 4 shows all four tags 5, 6, 7, and 8 separated from each other to be used for identification purposes according to the invention.

Figure 5:
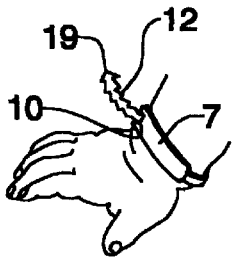
FIG. 5 shows a baby's hand wearing an identification bracelet according to the first embodiment of the invention.
Figure 6:
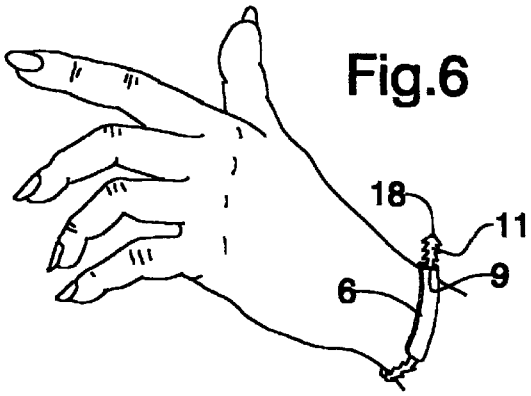
FIG. 6 shows a mother's hand wearing an identification bracelet according to the first embodiment of the invention.

Immediately after the newborn is delivered, the assembly of the invention is arranged with the clamps placed around umbilical cord C as shown in FIG. 2. Once the clamps have been closed onto the umbilical cord the cord is cut through section S and sub-assemblies 13, 14 are separated by tearing out along connection line 15. Then tag 6 is separated from tag 5 and tag 7 is separated from tag 8 as it is shown in FIG. 4, bracelet straps 11, 12 being put in the mother's wrist and the baby's wrist as it is shown in FIGS. 6, 5 respectively, whereby the mother and the baby are identified immediately after the delivery, under the obstetrician's sight, not only by a bracelet but also by the clamps in the baby's body and in the mother's cord section. Due to the saw-edged strap the bracelet can not be removed from the wrist except by breaking the bracelet.

In FIGS. 7–10 a second embodiment of the invention is depicted. A safety identification assembly is generally indicated by reference number 20 and comprises at least two sub-assemblies 21, 22 detachably connected to each other through a connecting holding portion 23 having a central cut section 24 arranged between, preferable equidistant from, identifying sub-assemblies 21, 22.

Figure 7:
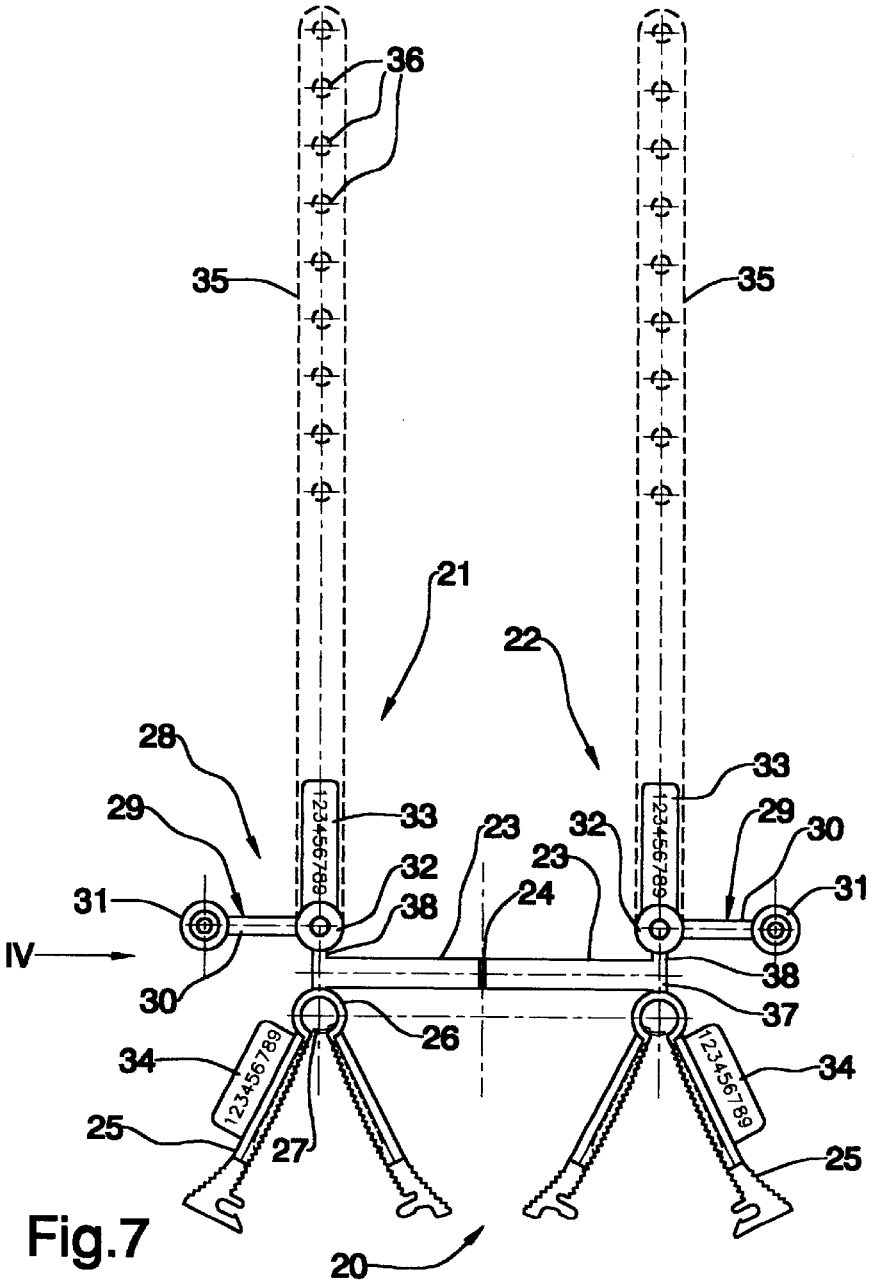
FIG. 7 shows a top plan view of safety identification assembly according to a second embodiment of the invention, with the clamps open to be placed around an umbilical cord.
Figure 8:
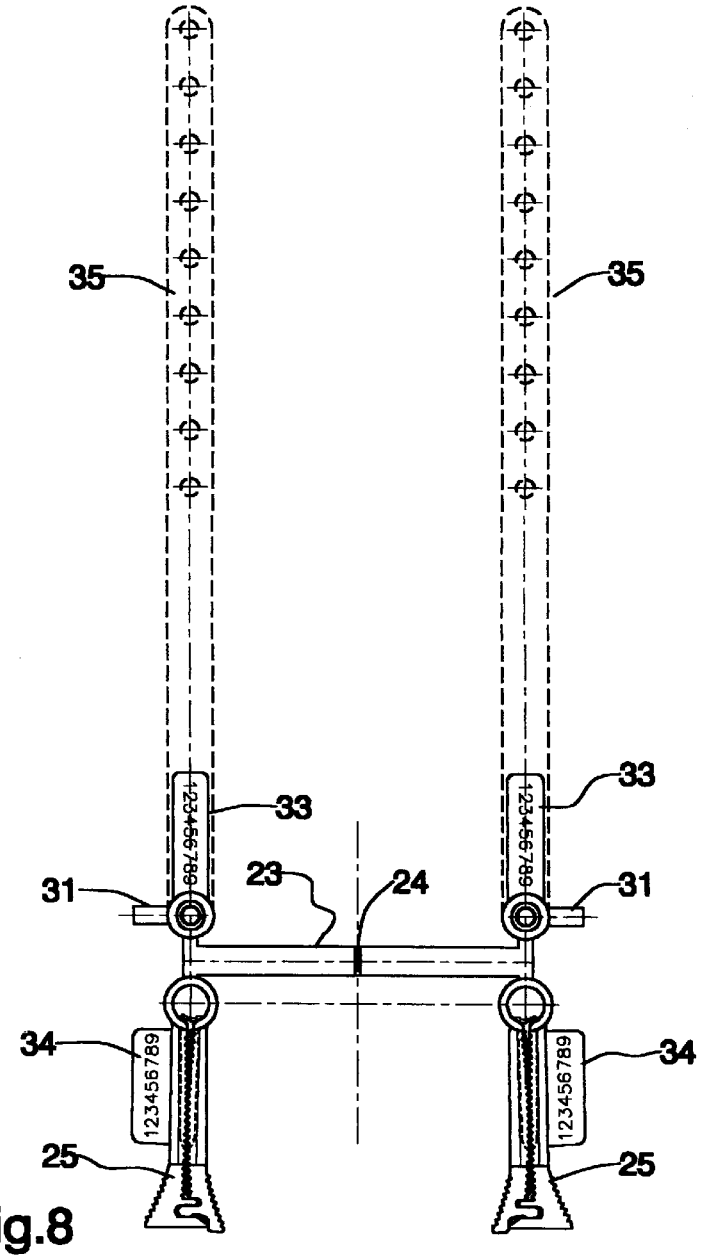
FIG. 8 shows a top plan view of the identification assembly of FIG. 7, with the clamps closed as if they were applied around an umbilical cord and the violation-proof locking means also closed to lock two ends of the bracelet strap.
Figure 9:
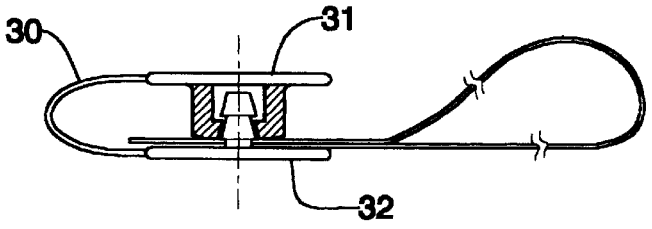
FIG. 9 shows a side elevation view of the violation-proof locking means in a close mode to lock two ends of the bracelet strap.
Figure 10:
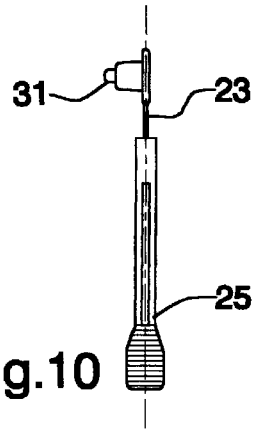
FIG. 10 shows a slide elevation view of a clamp and locking means according to arrow IV of FIG. 7

Each sub-assembly 21, 22 comprises a closing or strangulating clamp 25 having a resilient hinge 26 by means of which the clamps remains normally open as shown in FIG. 7 while it may be closed to a position shown in FIG. 8 wherein the umbilical cord may be strangulated under the jaws of the clamp as it is well known in the art. To obtain a complete sealing of the free cut ends of the umbilical cord in order to prevent any fluid communication between the interior of the cord and the baby or mother's body and any contaminated environment the clamp is provided with a protecting finger 28. Finger 28 form a barrier to prevent any cord portion from entering into the resilient hinge 26 in which event such portion of the cord would be out of the sealing jaws of the clamp and, therefore, the cord would remain open defining a communication between the outer environment and the interior of the baby or mother's body with the risks of any contamination for the patients.

Clamp 25 is joined to an end of connecting holding 23 and at one side thereof while at the opposite side a sealing device 28 is provided, the device comprising a violation-proof locking means 29 consisting of a short strip 30 including at opposite ends thereof respective first 31 and second 32 parts of a locking snap button. Sealing device 28 includes an identification tag 33 firmly joined to device 28 and clamp 25 include in like manner an identification tag 34 also firmly joined to the clamp. Tags 33, 34 contains an identification code engraved or printed in any reliable way in the tags, the identification code consisting of letters, numbers or any alphanumeric code fixed in an unalterable way. The code contained in tags 33, 34 are the same with the purpose of identifying simultaneously, as it was disclosed above in connection with the embodiment of FIGS. 1–6, the mother and her baby or babies.

Connected to one 32 of the snap button parts there is a relatively long bracelet strap 35 including a plurality of through orifices 36 arranged along most of the length of the strap. Although bracelet strap 35 is retained in button part 32 the strap can move freely to accommodate to any handling situation of the identification assembly during use or packaging. To form a close bracelet around the mother and or baby's wrist one of the orifices 36, selected depending of the wrist size, is connected to snap button part 32 and snap button part 31 is snapped onto part 32 (FIG. 9) to keep strap 35 trapped into button 31, 32 to form a close loop around the wrist. Snap button 31, 32 is a violation-proof locking button, therefore, the bracelet, once closed, can not be opened unless by breaking or cutting the same leaving enough violation evidence.

Both sub-assemblies 21, 22 each one formed by one half holding portion 23, one clamp 25 and one sealing device 28 are configured by only one integral piece obtained from a plastic bio-compatible material by injection, for example. Generally, straps 35 are made also from a plastic material but separately from clamps 25, portion 23 and devices 28 and the straps are thinner and more flexible than clamps 25, portion 23 and devices 28. Clamps 25 are preferably connected to portion 23 in a detachably manner through tearing bridges 37 formed by a weakened section in the material or any other means such as cuts (not shown). In like manner, sealing devices 28 are connected to portion 23 by means of tearing bridges 38.

Like in the procedure carried out with the assembly shown in FIGS. 1–6, once the newborn is delivered the assembly 20 is arranged so as to close each clamp 25 at both sides of a section of the umbilical cord to be cut into a portion remaining with the baby and a portion remaining attached to the mother's placenta. The umbilical cord and section 24 of the holding portion are cut simultaneously. Then clamps 25 and sealing devices are torn off the holding piece 23. Immediately after the clamps are separated from the sealing devices bracelets 35 are put around the mother and baby's wrists and sealed with snap button 31, 32 to remain fixed to the baby and the mother. All these steps are carried out immediately after the delivery, in a simultaneous mode and at the obstetrician's sight, to be under his control. In this way the mother and her baby are simultaneously identified with the clamps remaining fixed to their bodies and having the same code identification, without running any risk of a mistaken assigning of the baby to a mother other than the authentic one.

In addition to the identification and safety advantages provided by the assembly of the invention, there are other benefits obtained by using conventional and cost effective processes to obtain the product in a mass production way, such as by injection of plastic materials. As stated above, the clamps, holding piece 23 and sealing devices 28 may be obtained from injected plastic into one integral piece, while the straps can be obtained separately also by injection of plastic with different physical properties.

I claim:

1. A method for identifying a newborn and his/her mother in a delivery at a delivery room comprising the steps of:

providing a safety identification assembly comprising at least two sub-assemblies detachably connected to each other, the sub-assemblies comprising umbilical cord clamps to be clamped at both sides of a splitting section of an umbilical cord, sealing devices, each of which comprises a bracelet strap and a violation-proof lock to seal the bracelet strap around a wrist of one of the newborn and his/her mother, and an identification portion containing an identification code included on each umbilical cord clamp and each sealing device of the assembly;

arranging the two sub-assemblies relative to the umbilical cord so as to locate each clamp at both sides of the splitting section of the cord;

closing each clamp so as to strangulate the umbilical cord at both sides of the splitting section;

cutting said splitting section of the cord while separating said sub-assemblies from each other, the clamps remaining clamped in respective divided lengths of the umbilical cord;

separating said sealing devices from the clamps and putting the bracelet straps around the mother and baby's wrists respectively; and sealing the lock to safely retain the bracelets on the mother and baby's wrists.

* * * * *

UNITED STATES PATENT AND TRADEMARK OFFICE

CERTIFICATE OF CORRECTION

PATENT NO. : 6,212,808 B1
DATED : April 10, 2001
INVENTOR(S) : Rubel

It is certified that error appears in the above-identified patent and that said Letters Patent is hereby corrected as shown below:

Column 3,
Line 55, "portion 5" has been changed to -- portion 50 --;
Line 56, "portion 5" has been changed to -- portions 50 --; and
Line 57, "portion 5" has been changed to -- portion 50 --.

Column 4,
Line 64, "28" (both occurrences) has been changed to -- 27 --.

Signed and Sealed this

Twenty-ninth Day of January, 2002

*Attest:*

*Attesting Officer*

JAMES E. ROGAN
*Director of the United States Patent and Trademark Office*